United States Patent [19]

Meidel

[11] Patent Number: 4,651,381

[45] Date of Patent: Mar. 24, 1987

[54] BLOW AND SUCTION NOZZLE FOR HOUSEHOLD OR INDUSTRIAL SUCTION TOOLS

[76] Inventor: Karlheinz Meidel, Falkenbergstrasse 18, D-8721 Michelau, Fed. Rep. of Germany

[21] Appl. No.: 712,665

[22] Filed: Mar. 18, 1985

[30] Foreign Application Priority Data

Mar. 21, 1984 [DE] Fed. Rep. of Germany ..... 3410290
Jan. 25, 1985 [DE] Fed. Rep. of Germany ..... 3502064

[51] Int. Cl.[4] ..... A47L 5/14

[52] U.S. Cl. ..... 15/345; 15/387; 15/409

[58] Field of Search ..... 15/409, 387, 345

[56] References Cited

U.S. PATENT DOCUMENTS 2,064,344 12/1936 Good ..... 15/345 X
2,331,692 10/1943 Hunt ..... 15/387
3,328,827 7/1967 Lake et al. ..... 15/345 X
3,688,339 9/1972 Vincent et al. ..... 15/387

*Primary Examiner*—Chris K. Moore

[57] ABSTRACT

For the removal of dust, various types of jets are used, mostly as attachments to household and industrial suction tools.

In order to achieve a contactless and, therefore, protective cleaning, the attachable blow and suction jet according to this invention is configurated in such a way that a turbine wheel (7) positioned in a suction pipe (1) is driven by means of a suction tool and then moves a second turbine wheel (8) in a pressure pipe (5) via a shaft (9) thus generating compressed air. The compressed air is conducted to a blow pipe (31) via connecting pipes (24). With the use of an additional cap (26) the exhaust air can whirl with the intake air in some distance from the mouth of blow pipe (31) and be carried off between the connecting pipes (24) via the suction pipe (1) into the suction tool.

8 Claims, 5 Drawing Figures

BLOW AND SUCTION NOZZLE FOR HOUSEHOLD OR INDUSTRIAL SUCTION TOOLS

BACKGROUND OF THE INVENTION

The invention relates to nozzles for household or industrial suction tools; such nozzles serve as attachment (accessory) for the cleaning of objects.

For the removal of dust by suction, nozzles of various types are used, mostly as attachments to household and industrial suction tools. The combination of suction nozzles with brush inserts is intended to effect, at the same time, the sweeping and sucking of dust particles. Also known is the use of rotating brush parts. Thus the cleaning effect is intended to be intensified.

The above mentioned accessories come into direct contact with the objects to be cleaned and cause damage, especially, if the dust particles settle on delicate objects. Additionally, when cleaning rugged objects, not all dust particles are seized. Especially with small and lightweight objects, the danger of entanglement and overturning is to be pointed out.

There is known a vacuum cleaner (German Offenlegungsschrift DE-OS No. 22 18 351) which overcomes most of the above mentioned disadvantages by reversing the intake air after the filter and conducting it back to the nozzle as exhaust air. There is, however, a second separate pipe and tube system required, in addition to the usual suction pipe or suction tube.

U.S. Pat. No. 3,328,827 describes a vacuum cleaner the suction blower of which is driven by a pneumatic wheel whereby the compressed air is then blown out via nozzles around the suction jet. The normally used electric motor thus is replaced by the pneumatic wheel.

In contrast to this, it is an object of this invention to provide a nozzle for household or industrial suction tools which can be used at will for any suction tool. According to a further object, no additional power supply shall be required. Finally, it shall be possible to do the cleaning without coming into contact with and therefore without mechanical damage to the object to be cleaned.

SUMMARY OF THE INVENTION

To solve these objects the invention is characterized in that a first turbine wheel is located within the nozzle and is driven by the intake air flow and operates a second turbine wheel that generates a blown air flow directed to the object to be cleaned by means of at least one blow pipe.

According to the invention, the blow and suction nozzle utilizes the driving force of the intake air of vacuum cleaners or other suction tools in order to drive the turbine wheel positioned in the intake air flow. This moves a second turbine wheel in the compressed air part of the device which in turn generates an exhaust air flow via a blow pipe. Without additional power supply, thus a blow pressure together with the suction effect is achieved by means of a counterflow process. The raised dust particles are taken into the suction tool together with the suction flow existing anyway. By means of a coaxial arrangement of the turbine wheels, a technically uncomplicated and lightweight construction of the device can be achieved. With permanent lubrication, maintenance is not necessary.

In a preferred version of the invention, the nozzle consists of a pressure pipe in which ends coaxially a suction pipe whereby the thus resulting annular surface separates the pressure and suction area, and the blow pipe is connected to the pressure area via connecting tubes ending in an annular surface thereof. The connecting tubes enable an optional design of the blower section adapted to the respective purpose.

In an especially preferred version of the invention, a cap is put onto the nozzle in the suction area thereof, said cap being tapered at the mouth of the blow pipe in such a way that an eddy (air whirl) of the intake and exhaust air flows is generated. This controlled turbulence taking place at some distance from the mouth of the blow pipe achieves a noticeable cleaning effect on the objects to be cleaned. The loosened dust particles are seized from the whirling intake air flow without the object being blown at having to serve as a deflecting surface to return the exhaust air flow. Contrary to the known blow or suction nozzles having their highest effect in the immediate vicinity of their entrance ends, the blow and suction nozzle of the invention has its highest effect at a distance of e.g. approximately 5 cm from the mouth. Therefore, when cleaning especially small objects, there is no danger that these are overturned by the exhaust airflow or sucked into the intake airflow. With the cap removed, an especially strong blow pressure can be achieved as the blow pressure now is not influenced by the return flow of the intake air.

As a result of the construction as per the invention, the nozzle can be exchanged quickly and simply for other attachments. The working principle on which the invention is based can be used, however, also for other machines or instruments as an integrated part.

BRIEF DESCRIPTION OF THE DRAWING

In the following the invention is described in detail by means of some examples of design as shown in the drawings in which.

DETAILED DESCRIPTION OF PREFERRED EMBODIMENTS

Figure 1:
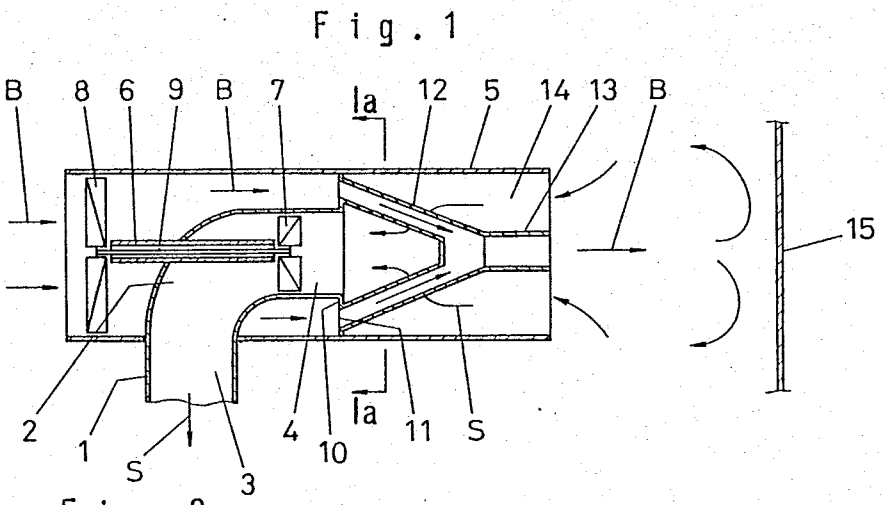
FIG. 1 is a longitudinal sectional view of a nozzle of the invention with turbine wheels set one behind the other on a common shaft.
Figure 1A:
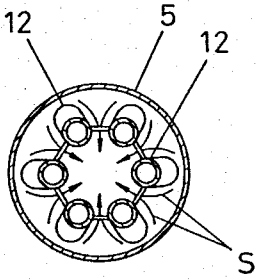
FIG. 1*a* is a sectional view along line Ia—Ia of FIG. 1.

According to FIGS. 1 and 1*a*, a suction pipe 1 consists of two straight-lined sections 3 and 4 connected by a knee 2 of 90°. Section 4 and knee 2 are located in a pressure pipe 5 coaxial with section 4, while section 3 runs sealed through the jacket of pressure pipe 5 to the outside serves for connection to a suction tool, e.g. the suction pipe of a vacuum cleaner. In section 4, a coaxial tube 6 is mounted projecting into pressure pipe 5 through a wall of knee 3. At both ends of tube 6, two turbine wheels 7 and 8 are rotatably mounted one behind the other and which are connected by shaft 9. The wing rims of these turbine wheels 7 and 8 are set in such a way that turbine wheel 7 in the suction pipe is driven by the intake air flow of the suction tool thereby starting to move also turbine wheel 8 in pressure pipe 5 via shaft 9, and the exhaust air flow generated by wheel 8 is directed opposite to the intake air flow, as indicated by arrows S (intake air flow) and arrows B (exhaust air flow). On the free side of turbine wheel 7, suction pipe 1 and pressure pipe 5 are connected by an annular plate 10 being equipped with holes 11 spaced in circumferential direction, to which holes connecting tubes 12 are attached in a conical arrangement. These connecting tubes 12 end in a blow pipe 13 which ends at approximately the same plane as pressure pipe 5 so that an annular space 14 is formed between the blow pipe 13 and the pressure pipe 5, which space is only interrupted by the connecting tubes 12. The outer jacket of suction pipe 1 separates the pressure and suction area.

The compressed air generated by turbine wheel 8 at first flows through the area between suction pipe 1 and pressure pipe 5 and from there it arrives in blow pipe 13 through the connecting tubes 12. The emerging exhaust air flow is directed, as indicated by the arrows, to any object, e.g. a plate 15, is then reflected from that and mixed with the intake air, and is finally together with the intake air sucked into suction pipe 1 whereby the intake air flow passes at first the annular space 14, then runs through between the connecting tubes 12, and finally arrives in suction pipe 1 through a central opening of annular plate 10.

Figure 2:
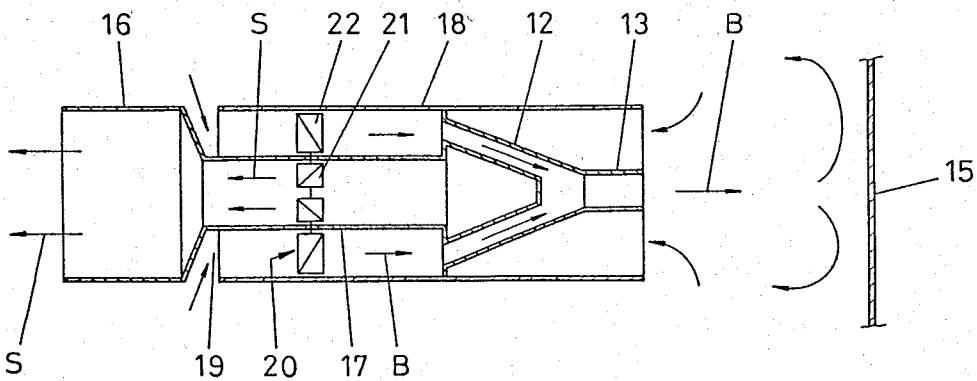
FIG. 2 is a longitudinal sectional view of a nozzle of the invention with turbine wheels set coaxially at one plane.

In the embodiment according to FIG. 2, a suction pipe 16 has a constriction 17 at its front end surrounded by a pressure pipe 18 being distanced from the broadened part of suction pipe 16 by an annular space 19 to let the air in. The rear end of suction pipe 16 serves as connection to a suction tool. To generate the intake or suction, and exhaust or blow air flows (arrows S and B, respectively), a common turbine wheel unit 20 is provided which has an inner turbine wheel 21 rotatably mounted in the constriction 17 and, coaxially therewith, an outer ring-shaped turbine wheel 22 that is only rotatably mounted in the annular space between pressure pipe 18 and constriction 17. The wing rims of the turbine wheels 21,22 are set into opposite directions so that the intake air and the exhaust air flow are opposite to each other. In the area of turbine wheel unit 20 the constriction 17 is divided to accomodate a sliding surface of turbine wheel unit 20 located between the two turbine wheels 21 and 22 for bearing both of them at the same time. A suitable sealing in this area is also provided. Otherwise, the configuration corresponds with FIGS. 1 and 1*a*. The intake air and the exhaust air again flow, as indicated by the arrows, in opposite directions, i.e. similar to a counterflow.

Figure 3:
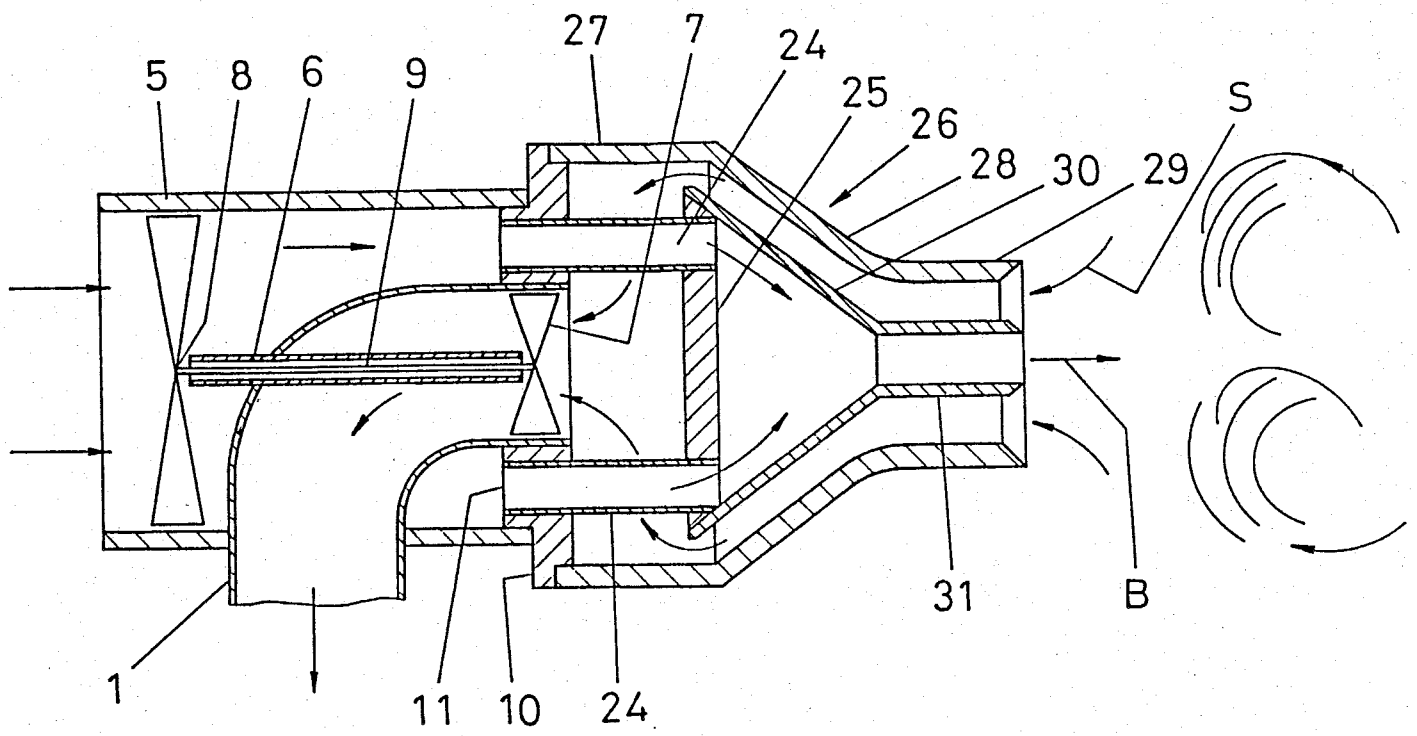
FIG. 3 is a longitudinal sectional view of a nozzle of the invention with a cap in the suction area of the nozzle.
Figure 4:
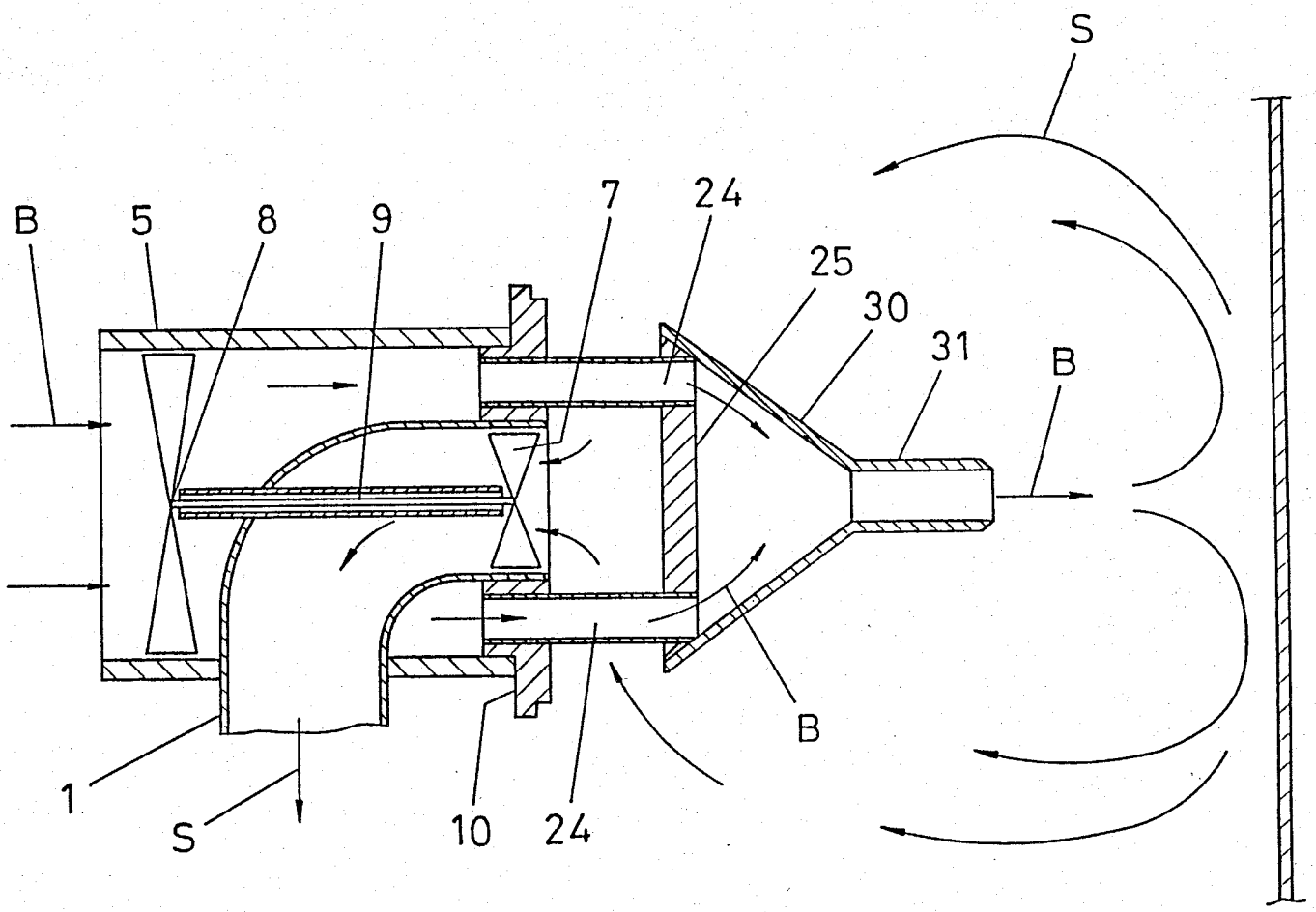
FIG. 4 shows the nozzle of FIG. 3 without cap.

The embodiment of FIGS. 3 and 4 corresponds with the embodiment of FIG. 1 in its rear section, and therefore identical parts are designated by the same reference numbers. Connecting tubes 24 are, however, mounted parallel to the axis of a blow pipe 31. These tubes 24 are set into the holes 11 of annular plate 10 and end in the openings of a circular plate 25 the radius of which is somewhat smaller than the radius of the pressure pipe 5 ending at annular plate 10. According to FIG. 3, a cap 26 can be put onto the nozzle. Cap 26 has an annular section 27 that surrounds the connecting tubes 24 and is slid with clamp fit onto the annular plate 10. Preferably, cap 26 is coaxial with the nozzle. From the location at which plate 25 is provided, cap 26 has for example a cone-like tapering portion 28 ending at the front end of the jet in a cylindrical part 29. Similarly, for example a conical wall section 30 is mounted onto plate 25 and ends in a cylindrical section 31. Thus a conical space is formed between tapering portion 28 and wall section 30 whereas a cylindrical annular space is formed between part 29 and section 31. Part 29 and section 31 end in approximately the same plane. Similar to the other embodiments, the exhaust air is blown out through the connecting pipes 24 and the section 31 being effective as a blow pipe. With the cap 26 put on, however, the exhaust air and the intake air whirl into each other automatically at some distance from the mouth of section 31 (compare the arrows), and then the united air flows are sucked through the cylindrical and conical spaces respectively and between the connecting pipes 24 into suction pipe 1. With the cap 26 removed as shown in FIG. 4, the exhaust air is deflected from an object as shown in FIGS. 1 and 2 and then transported as intake air through the space between the connecting pipes 24 into suction pipe 1.

The effect of the jet can be influenced by the following measures:

Position of blow pipe mouth with respect to the suction nozzle of the outer cylinder,
Modification (reduction) of the suction flow,
Modification (reduction) of the exhaust flow,
Shape of blow pipe nozzle, and
Shape of suction nozzle of pressure pipe or cap.

According to further embodiments of the invention, the pressure pipes can also be mounted inside the suction pipes such that the suction pipes are the outside pipes of the nozzle.

I claim:

1. A blow and suction nozzle for a suction apparatus, comprising: a first tube; a second tube having a first section with a free end serving as a suction opening and located within said first tube, said second tube having a second section to be coupled to said suction apparatus; an annular space being defined by said first and second tubes; a third tube having one end facing said suction opening and another end serving as a blow opening; at least one connecting tube connecting said annular space to said one end of said third tube; a first turbine wheel rotatably mounted in said first tube for producing during rotation a stream of compressed air in the direction of said connecting tube; a second turbine wheel rotatably mounted within said second tube and rigidly coupled to said first turbine wheel, whereby, when air is sucked in through said suction opening, and through said second tube, said first turbine wheel is rotated and thereby compressed air will be pressed through said annular space and exhausted through said blow opening of said third tube.

2. A nozzle according to claim 1, wherein said first and second turbine wheels are mounted one behind the other on a common shaft projecting through a wall portion of said second tube.

3. A nozzle according to claim 2, wherein said first section of said second tube is coaxially located within said first tube, and comprises a knee coupling said first section to said second section, said second section projecting through a wall portion of said first tube.

4. A nozzle according to claim 1, wherein said first and second turbine wheels are parts of a common turbine unit having an inner turbine wheel located within said second tube and an annular outer turbine wheel coaxially aligned with said inner turbine wheel and located within said annular space, and wherein said second tube is divided within the region of said turbine wheel unit for accommodating a mounting surface between both turbine wheels.

5. A nozzle according to claim 1, wherein said third tube is located within said first tube and terminates substantially in one plane with said first tube.

6. A nozzle according to claim 1, wherein said first section of said second tube is a constriction of said first section located within said first tube.

7. A nozzle according to claim 1, comprising an annular plate coupling said first tube and said second tube at a side facing said third tube, a plurality of connecting tubes being provided, said annular plate having a plurality of holes spaced in circumferential direction thereof, said connecting tubes being connected to said holes such that said air sucked through said suction opening and said second tube passes between said connecting holes.

8. A nozzle according to claim 7, wherein said first tube substantially ends at said annular plate, wherein a tubular cap is releasably placed onto said annular plate at a side thereof opposite to said first tube and substantially accommodating said third tube, and wherein said cap and said third tube have tapered portions such that the air blown out and the air sucked in are whirled in front of the blowing opening of said third tube.

* * * * *